US010697084B2

(12) United States Patent
Wang et al.

(10) Patent No.: US 10,697,084 B2
(45) Date of Patent: Jun. 30, 2020

(54) HIGH RESISTANCE VIRTUAL ANODE FOR ELECTROPLATING CELL

(71) Applicant: TAIWAN SEMICONDUCTOR MANUFACTURING COMPANY LIMITED, Hsin-Chu (TW)

(72) Inventors: Po-Wei Wang, Taichung (TW); Chun-Lin Chang, Jhubei (TW)

(73) Assignee: TAIWAN SEMICONDUCTOR MANUFACTURING COMPANY LIMITED, Hsin-chu (TW)

( * ) Notice: Subject to any disclaimer, the term of this patent is extended or adjusted under 35 U.S.C. 154(b) by 29 days.

(21) Appl. No.: 16/205,307

(22) Filed: Nov. 30, 2018

(65) Prior Publication Data

US 2019/0100854 A1 Apr. 4, 2019

Related U.S. Application Data

(62) Division of application No. 15/154,986, filed on May 14, 2016, now Pat. No. 10,167,567.

(60) Provisional application No. 62/261,209, filed on Nov. 30, 2015.

(51) Int. Cl.

| | |
|---|---|
| ***C25D 17/12*** | (2006.01) |
| ***C25D 7/12*** | (2006.01) |
| ***C25D 17/00*** | (2006.01) |

(52) U.S. Cl.

CPC ..... *C25D 17/12* (2013.01); *C25D 7/12* (2013.01); *C25D 17/001* (2013.01); *C25D 17/007* (2013.01); *C25D 17/008* (2013.01)

(58) Field of Classification Search

CPC ..... C25D 17/12; C25D 17/001
USPC ..... 204/196.28
See application file for complete search history.

(56) References Cited

U.S. PATENT DOCUMENTS

| | | | | |
|---|---|---|---|---|
| 6,106,687 | A | 8/2000 | Edelstein | |
| 6,261,426 | B1 | 7/2001 | Uzoh et al. | |
| 6,685,814 | B2 | 2/2004 | Uzoh et al. | |
| 8,475,636 | B2 | 7/2013 | Mayer et al. | |
| 8,475,644 | B2 | 7/2013 | Mayer et al. | |
| 9,309,604 | B2 | 4/2016 | Mayer et al. | |
| 2001/0050233 | A1 | 12/2001 | Uzoh et al. | |
| 2003/0092261 | A1 * | 5/2003 | Kondo | B24B 37/005 438/638 |
| 2004/0000487 | A1 | 1/2004 | Bonkass et al. | |
| 2010/0044236 | A1 | 2/2010 | Mayer et al. | |
| 2010/0116672 | A1 | 5/2010 | Mayer et al. | |
| 2013/0137242 | A1 | 5/2013 | He et al. | |
| 2013/0327650 | A1 | 12/2013 | Mayer et al. | |
| 2016/0333495 | A1 | 11/2016 | Kagajwala et al. | |

FOREIGN PATENT DOCUMENTS

| | | | |
|---|---|---|---|
| CN | 102459717 | A | 5/2012 |
| JP | 2001-217207 | A | 8/2001 |

* cited by examiner

*Primary Examiner* — Brian W Cohen
(74) *Attorney, Agent, or Firm* — Cooper Legal Group, LLC

(57) ABSTRACT

A high resistance virtual anode for an electroplating cell includes a first layer and a second layer. The first layer includes a plurality of first holes through the first layer. The second layer is over the first layer and includes a plurality of second holes through the second layer.

20 Claims, 7 Drawing Sheets

HIGH RESISTANCE VIRTUAL ANODE FOR ELECTROPLATING CELL

RELATED APPLICATIONS

This application is a divisional of and claims priority to U.S. Non-Provisional application Ser. No. 15/154,986, titled "HIGH RESISTANCE VIRTUAL ANODE FOR ELECTROPLATING CELL" and filed on May 14, 2016, which claims priority to U.S. Provisional Application Ser. No. 62/261,209, titled "TUNABLE HRVA FOR BEOL ECP ON 450MM GENERATION" and filed on Nov. 30, 2015. U.S. Non-Provisional application Ser. No. 15/154,986 and U.S. Provisional Application Ser. No. 62/261,209 are herein incorporated by reference.

BACKGROUND

The manufacture of semiconductor devices often requires the formation of electrical conductors on semiconductor wafers. For example, electrically conductive leads on the wafer are often formed by electroplating (depositing) an electrically conductive layer such as copper on the wafer and into patterned trenches.

Electroplating involves making electrical contact with the wafer surface upon which the electrically conductive layer is to be deposited (hereinafter the "wafer plating surface"). Current is then passed through a plating solution (i.e. a solution containing ions of the element being deposited, for example a solution containing $Cu^{2+}$) between an anode and the wafer plating surface (the wafer plating surface being the cathode). This causes an electrochemical reaction on the wafer plating surface which results in the deposition of the electrically conductive layer.

To minimize variations in characteristics of the devices formed on the wafer, it is important that the electrically conductive layer be deposited uniformly (with a uniform thickness) over the wafer plating surface. However, conventional electroplating processes produce nonuniformity in the deposited electrically conductive layer due to the "edge effect". The edge effect is the tendency of the deposited electrically conductive layer to be thicker near the wafer edge than at the wafer center. Accordingly, improvements in methods of avoiding the edge effect continue to be sought.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
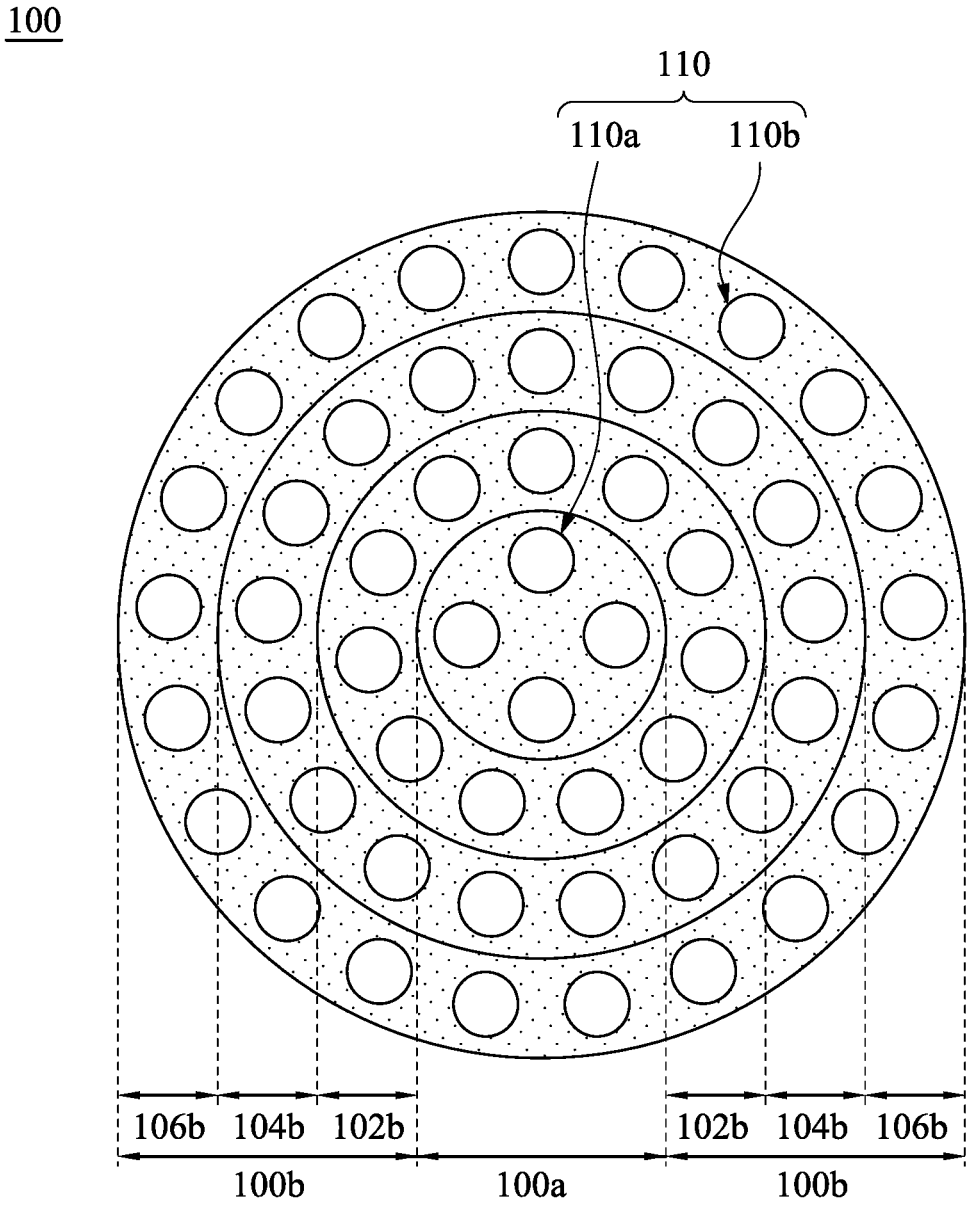
FIG. 1 is a top view of a first layer in accordance with some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The electroplating cell may be otherwise oriented (rotated 90 degrees or at other orientations) and the spatially relative descriptors used herein may likewise be interpreted accordingly.

As mentioned above, to minimize variations in characteristics of the devices formed on the wafer, it is important that the electrically conductive layer be deposited uniformly (with a uniform thickness) over the wafer plating surface. However, conventional electroplating processes produce nonuniformity in the deposited electrically conductive layer due to the "edge effect". The edge effect is the tendency of the deposited electrically conductive layer to be thicker near the wafer edge than at the wafer center.

Accordingly, the present disclosure provides a high resistance virtual anode (HRVA) (also called as flow diffuser plate) for an electroplating cell, which includes a first layer and a second layer stacked with each other. The first layer and the second layer respectively have first holes and second holes, and the first layer and/or the second layer can be rotated to adjust through hole size. In other words, the high resistance virtual anode including the first layer and the second layer has a pepper pot-like structure to adjust the through hole size. In addition, the first layer and/or the second layer may have a plurality of regions, and each of the regions can be rotated independently to adjust the through hole size at different positions to arbitrarily modify electric current flux and plating solution flow, and thus to form desired thickness profile of an electrically conductive layer to be deposited on the substrate (e.g., semiconductor wafer). Therefore, the high resistance virtual anode of the present disclosure can be widely applied in the electroplating process. Specifically, for example, the high resistance virtual anode of the present disclosure can be applied to not only a 300 mm wafer but also a bigger wafer, such as a 450 mm wafer, but not limited thereto, for forming uniformly electrically conductive layer during the electroplating process.

FIG. 1 is a top view of a first layer 100 in accordance with some embodiments of the present disclosure. As shown in FIG. 1, the first layer 100 includes a plurality of first holes 110 through the first layer 100. In some embodiments, each of the first holes 110 has a substantially or entirely same diameter. However, in practical applications, size and distribution of the first holes 110 can be adjusted to meet requirements, and not limited to those shown in FIG. 1. In some embodiments, the first layer 100 is made of an electrically insulating material.

In some embodiments, the first layer 100 is rotatable. In some embodiments, the first layer 100 includes a rotatable central portion 100*a* and a rotatable peripheral portion 100*b*. The rotatable peripheral portion 100*b* surrounds the rotatable central portion 100*a*. In some embodiments, the rotatable central portion 100*a* and the rotatable peripheral portion 100*b* are configured to control through hole size of the high resistance virtual anode, and thus to modify electrical resistance and electric current flux of the electroplating process. In other embodiments, the first layer includes an unrotatable central portion and a rotatable peripheral portion surrounding the unrotatable central portion.

In some embodiments, the rotatable peripheral portion 100*b* includes a plurality of rotatable ring-shaped portions 102*b*, 104*b*, 106*b* coaxially surrounding the rotatable central portion 100*a*. In practical applications, an amount and a size (e.g., width in top view) of the ring-shaped portions can be adjusted to meet requirements, and not limited to those shown in FIG. 1.

In some embodiments, a first portion 110*a* of the first holes 110 are through the rotatable central portion 100*a* of the first layer 100, and a second portion 110*b* of the first holes 110 are through the rotatable peripheral portion 100*b* of the first layer 100. In practical applications, size and distribution of the first portion 110*a* of the first holes 110 and those of the second portion 110*b* of the first holes 110 can be the same or different to meet requirements, and not limited to those shown in FIG. 1.

Figure 2:
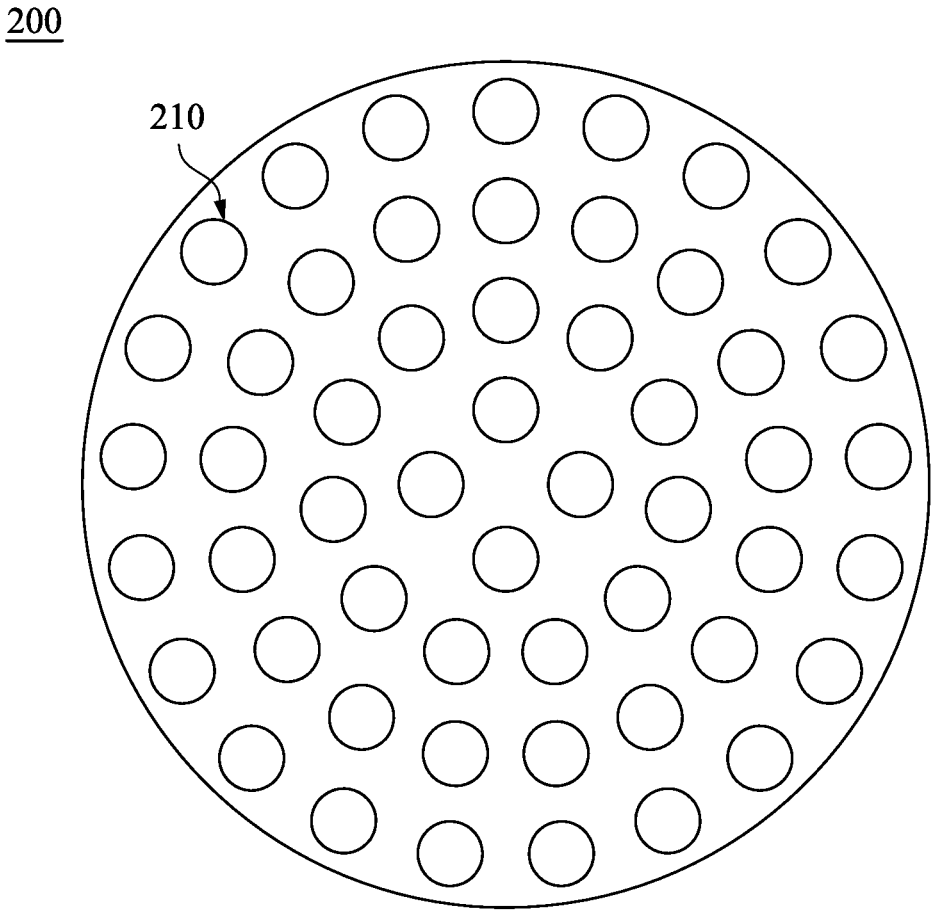
FIG. 2 is a top view of a second layer in accordance with some embodiments of the present disclosure.

FIG. 2 is a top view of a second layer 200 in accordance with some embodiments of the present disclosure. As shown in FIG. 2, the second layer 200 includes a plurality of second holes 210 through the second layer 200. In some embodiments, each of the second holes 210 has a substantially or entirely same diameter. However, in practical applications, size and distribution of the second holes 210 can be adjusted to meet requirements, and not limited to those shown in FIG. 2. In some embodiments, the second layer 200 is made of an electrically insulating material.

In some embodiments, one of the first holes 110 of FIG. 1 is configured to partially or fully overlap with one of the second holes 210 of FIG. 2. In some embodiments, the second holes 210 of FIG. 2 have hole distribution the same as hole distribution of the first holes 110 of FIG. 1. However, in practical applications, hole distribution of the first layer 100 may be different from hole distribution of the second layer 200, and not limited to those shown in FIGS. 1 and 2.

Figure 3A:
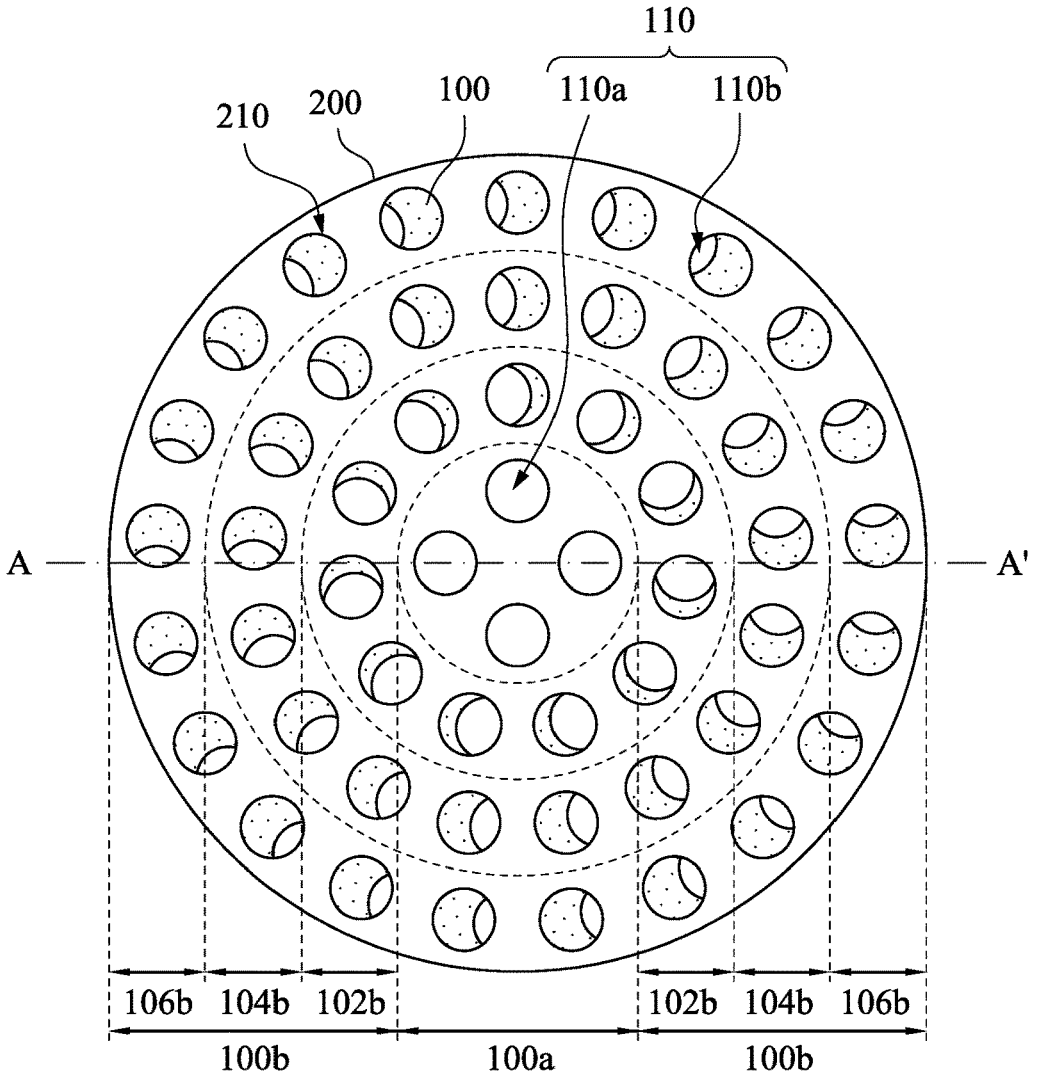
FIG. 3A is a top view of a first layer and a second layer thereover in accordance with some embodiments of the present disclosure.

FIG. 3A is a top view of a first layer 100 and a second layer 200 thereover in accordance with some embodiments of the present disclosure. As shown in FIG. 3A, the second layer 200 is disposed over the first layer 100, and the rotatable central portion 100*a* of the first layer 100 and the rotatable peripheral portion 100*b* (e.g., the rotatable ring-shaped portions 102*b*, 104*b*, 106*b*) can be independently rotated. The plating solution will flow through a plurality of overlapped portions of the first holes 110 and the second holes 210 during the electroplating process, and thus to form desired thickness profile of the electrically conductive layer to be deposited on the substrate.

In some embodiments, as shown in FIG. 3A, the through hole (i.e., overlapped portion of the first hole 110 and the second hole 210) at center has an area greater than that at periphery, and thus a percentage of the electric current flux passing through the center of the high resistance virtual anode will be higher than a percentage of the electric current flux passing through the periphery of the high resistance virtual anode to avoid the "edge effect."

Figure 3B:
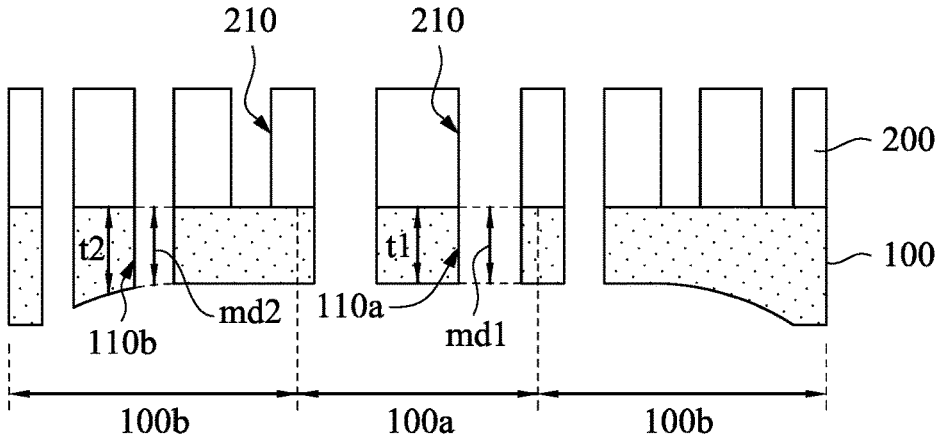
FIG. 3B is a cross-sectional view of the first layer and the second layer taken along a section line AA' of FIG. 3A in accordance with some embodiments of the present disclosure.

FIG. 3B is a cross-sectional view of the first layer 100 and the second layer 200 taken along a section line AA' of FIG. 3A in accordance with some embodiments of the present disclosure. As shown in FIG. 3B, center of the first layer 100 (e.g., rotatable central portion 100*a*) has a thickness t1 less than or equal to a thickness t2 of periphery of the first layer 100 (e.g., rotatable peripheral portion 100*b*). In some embodiments, the thickness t1 or t2 is in a range of 2 cm to 15 cm. In some embodiments, the thickness t1 or t2 is in a range of 2 cm to 5 cm, 5 cm to 8 cm, 8 cm to 12 cm or 12 cm to 15 cm. In some embodiments, the thickness t1 is in a range of 2 cm to 8 cm. In some embodiments, the thickness t2 is in a range of 8 cm to 15 cm. In some embodiments, thickness of the first layer 100 is gradually increased from center to periphery. In some embodiments, the first layer 100 is plano concave-like shaped in cross-sectional view.

In some embodiments, a first portion 110*a* of the first holes are through the rotatable central portion 100*a* of the first layer 100, and a second portion 110*b* of the first holes are through the rotatable peripheral portion 100*b* of the first layer 100. In some embodiments, one of the first portion 110*a* of the first holes has a maximum depth md1 less than or equal to a maximum depth md2 of one of the second portion 110*b* of the first holes.

In some embodiments, the second layer 200 has uniform thickness. In some embodiments, the second layer 200 has a thickness in a range of 2 cm to 15 cm. In some embodiments, the second layer 200 has a thickness in a range of 2 cm to 5 cm, 5 cm to 8 cm, 8 cm to 12 cm or 12 cm to 15 cm. In some embodiments, a second hole 210 of the second layer 200 is substantially or entirely aligned with one of the first portion 110*a* of the first holes of the first layer 100. In some embodiments, a second hole 210 of the second layer 200 is misaligned with one of the second portion 110*b* of the first holes of the first layer 100.

In other embodiments, center of the second layer has a thickness less than a thickness of periphery of the second layer. In other embodiments, thickness of the second layer is gradually increased from center to periphery. In other embodiments, the second layer is plano concave-like shaped in cross-sectional view.

In some embodiments, a high resistance virtual anode includes three layers or more than three layers. In some embodiments, referring to FIG. 3B, a high resistance virtual anode includes not only the first layer 100 and the second layer 200 but also a third layer (not shown). In some embodiments, the third layer is over the second layer 200 or beneath the first layer 100.

Figure 4:
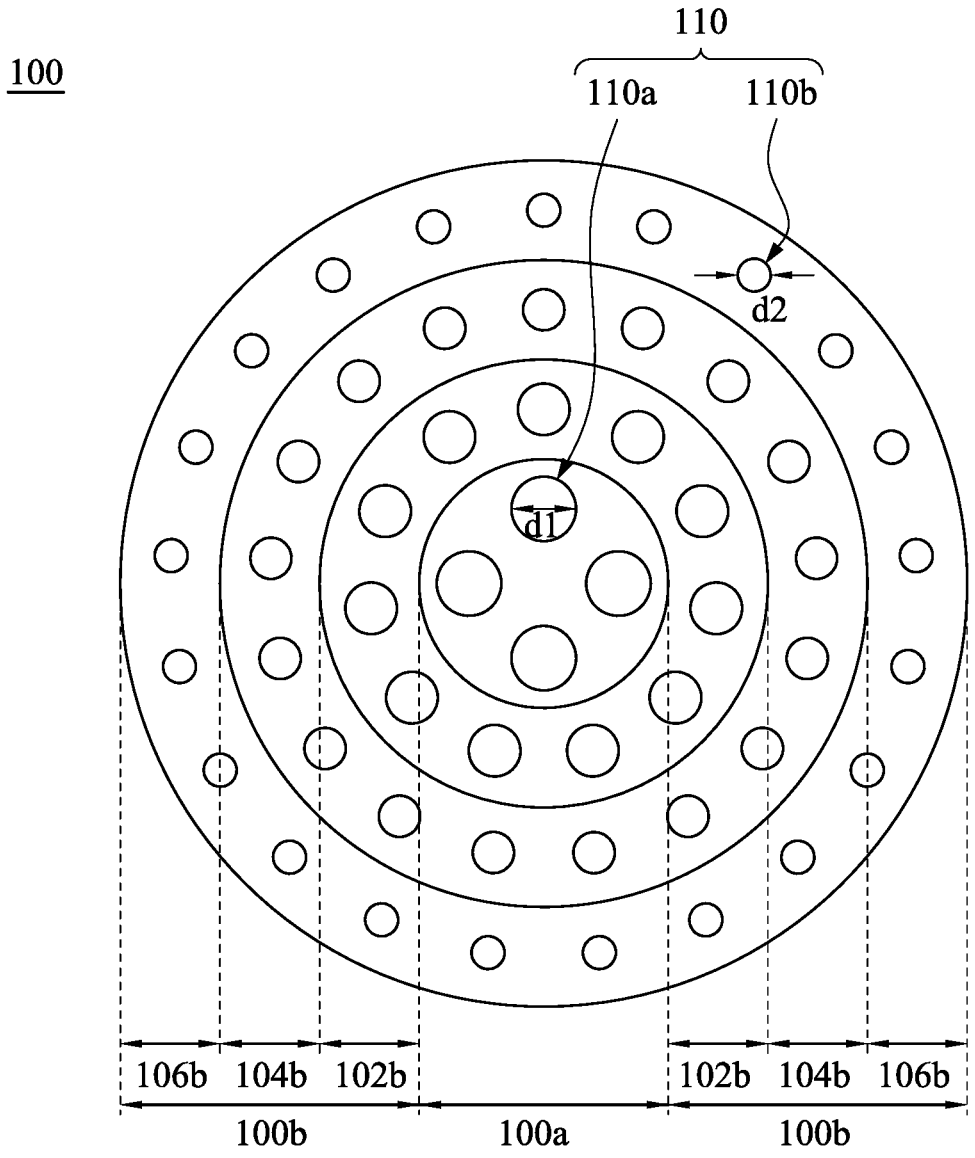
FIG. 4 is a top view of a first layer in accordance with some embodiments of the present disclosure.

FIG. 4 is a top view of a first layer 100 in accordance with some embodiments of the present disclosure. As shown in FIG. 4, the first layer 100 includes a plurality of first holes 110 through the first layer 100. In some embodiments, the first holes 110 at different regions have different diameters.

In some embodiments, the first layer 100 includes a rotatable central portion 100*a* and a rotatable peripheral portion 100*b*. The rotatable peripheral portion 100*b* surrounds the rotatable central portion 100*a*. In some embodiments, the rotatable central portion 100*a* and the rotatable peripheral portion 100*b* are configured to control through hole size of the high resistance virtual anode, and thus to modify electrical resistance and electric current flux of the electroplating process. In some embodiments, the rotatable peripheral portion 100*b* includes a plurality of rotatable ring-shaped portions 102*b*, 104*b*, 106*b* coaxially surrounding the rotatable central portion 100*a*.

In some embodiments, a first portion 110*a* of the first holes 110 are through the rotatable central portion 100*a* of the first layer 100, and a second portion 110*b* of the first holes 110 are through the rotatable peripheral portion 100*b* of the first layer 100. In some embodiments, one of the first portion 110*a* of the first holes 110 has a diameter d1 greater than a diameter d2 of one of the second portion 110*b* of the first holes 110. In some embodiments, the rotatable central portion 100*a* has an opening ratio higher than an opening ratio of the rotatable peripheral portion 100*b*. The term "opening ratio" refers to an area occupied by holes against the area.

Figure 5:
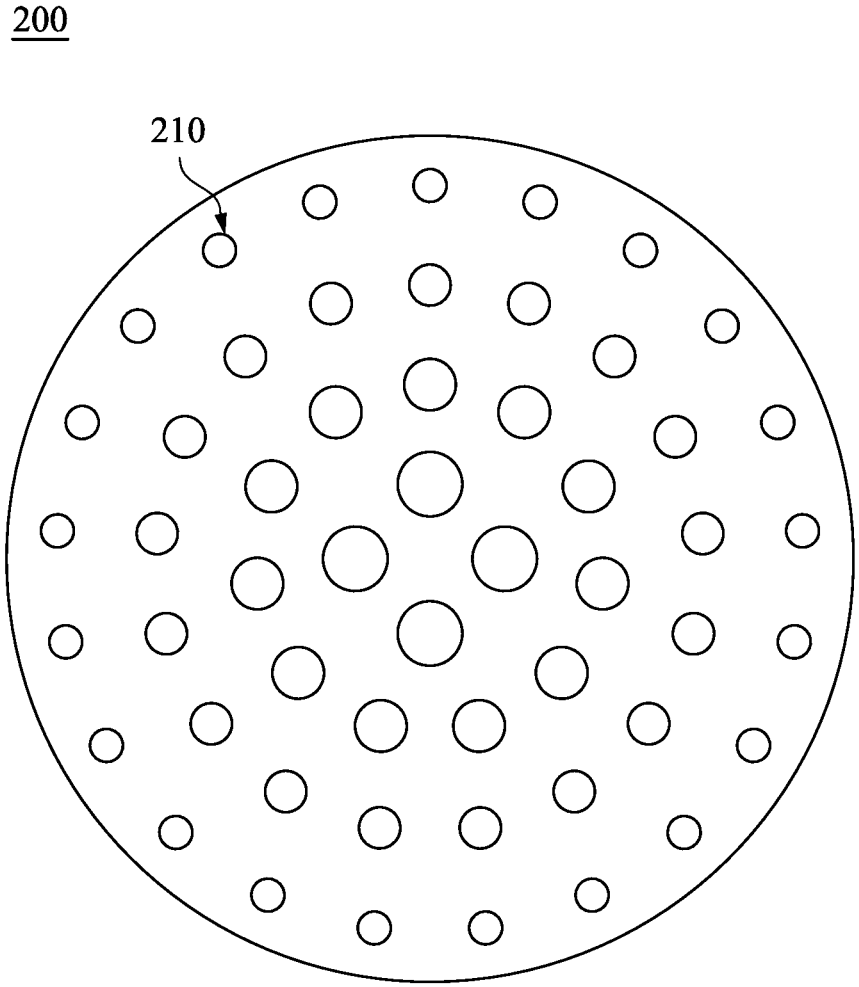
FIG. 5 is a top view of a second layer in accordance with some embodiments of the present disclosure.

FIG. 5 is a top view of a second layer 200 in accordance with some embodiments of the present disclosure. As shown in FIG. 5, the second layer 200 includes a plurality of second holes 210 through the second layer 200. In some embodiments, the second holes 210 at different regions have different diameters. In some embodiments, one of the first holes 110 of FIG. 4 is configured to partially or fully overlap with one of the second holes 210 of FIG. 5.

Figure 6:
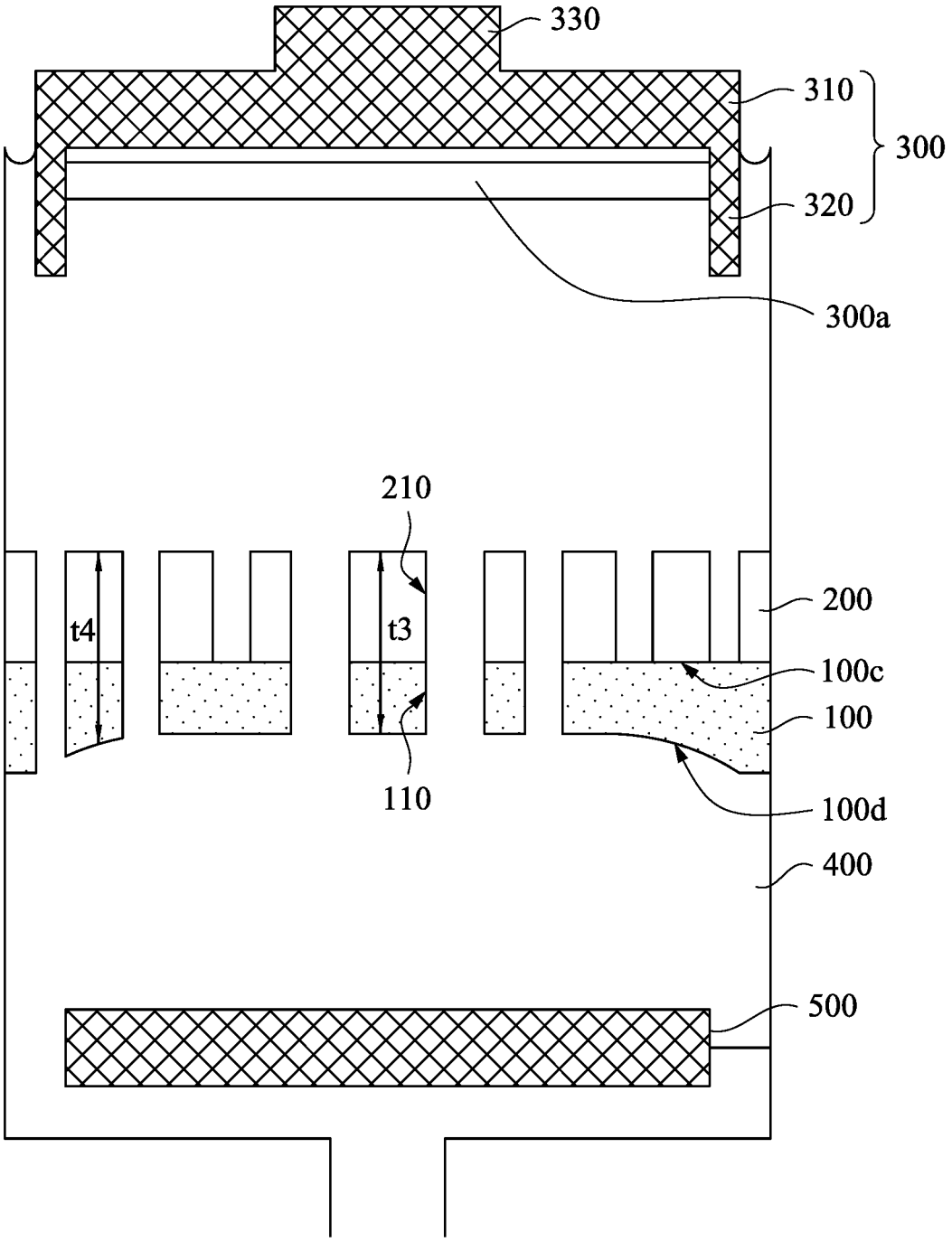
FIG. 6 is a cross-sectional view of an electroplating cell including a high resistance virtual anode therein in accordance with some embodiments of the present disclosure.

FIG. 6 is a cross-sectional view of an electroplating cell including a high resistance virtual anode therein in accordance with some embodiments of the present disclosure. In some embodiments, the electroplating cell includes a substrate holder 300 for holding a substrate 300*a* (e.g., semiconductor wafer), a plating bath 400, an anode 500 (i.e., actual anode) and a high resistance virtual anode, such as the high resistance virtual anode of FIG. 3B including the first layer 100 and the second layer 200. In some embodiments, the electroplating cell further includes other functional elements, such as a diffuser, an electroplating solution inlet tube, a rinse drain line, an electroplating solution return line, any other functional element or a combination thereof.

In some embodiments, the electroplating cell is included in an electroplating tool (not shown) for electroplating substrates (e.g., semiconductor wafers). The substrates may be fed to the electroplating tool. A robot can retract and move the substrates in multiple dimensions from one station to another station. The electroplating tool may also include other modules configured to perform other necessary electroplating sub-processes, such as spin rinsing and drying, metal and silicon wet etching, pre-wetting and pre-chemical treating, photoresist stripping, surface pre-activation, etc.

The substrate holder 300 is configured to receive and hold (support) the substrate 300*a* during electroplating deposition. The term "substrate holder" may also be called as wafer holder, workpiece holder, clamshell holder, clamshell assembly and clamshell. In some embodiments, the substrate holder 300 is Novellus Systems' Sabre® tool. In some embodiments, the substrate holder 300 can be lifted vertically either up or down to immerse the substrate 300*a* into the plating bath 400 in the electroplating cell via an actuator. In some embodiments, the substrate 300*a* has an electrically conductive seed layer (not shown) thereon.

In some embodiments, the substrate holder (clamshell) 300 includes two main components, which are a cone 310 and a cup 320. In some embodiments, the cup 320 is configured to provide a support upon which the substrate 300*a* rests. In some embodiments, the cone 310 is over the cup 320 and configured to press down on a backside of the substrate 300*a* to hold it in place. In some embodiments, the substrate holder 300 is driven by a motor (not shown) via a spindle 330, as shown in FIG. 6. In some embodiments, the spindle 330 transmits torque from the motor to the substrate holder 300 causing rotation of the substrate 300*a* held therein during the electroplating process. In some embodiments, an air cylinder within the spindle 330 also provides a vertical force for engaging the cup 320 with the cone 310.

In some embodiments, the high resistance virtual anode is configured to modify electric current flux and plating solution flow between the actual anode 500 and the surface of the substrate 300*a*. In some embodiments, periphery of the high resistance virtual anode including the first layer 100 and the second layer 200 is secured (sealed) to a wall (not marked) of the plating bath 400 (also called as electroplating chamber) and is positioned at a distance from the substrate 300*a*. The distance is determined by the desired thickness profile of the electrically conductive layer to be deposited on the substrate 300*a*. The closer high resistance virtual anode is to the substrate 300*a*, the greater the influence high resistance virtual anode has on the resulting thickness profile of the electrically conductive layer to be deposited on the substrate 300*a*. Since the high resistance virtual anode is secured to the wall of the plating bath 400, the plating solution flows through the first holes 110 and the second holes 210 of the high resistance virtual anode.

In some embodiments, a power supply (not shown), such as a DC power supply, has a negative output lead (not shown) electrically connected to the substrate 300*a*. In some embodiments, the positive output lead of the power supply is electrically connected to the actual anode 500 located in the plating bath 400. During use, the power supply biases the substrate 300*a* to have a negative potential relative to the actual anode 500, causing an electrical current to flow from the actual anode 500 through the high resistance virtual anode to the substrate 300*a*. As used herein, electrical current flows in the same direction as the net positive ion flux and opposite the net electron flux, in which electric current is defined as the amount of charge flowing through an area per unit time. This also causes an electric current flux from the actual anode 500 through high resistance virtual anode to the substrate 300*a*, in which the electric current flux is defined as the number of lines of forces (field lines) through an area. This causes an electrochemical reaction (e.g. $Cu^{2+}+2e^{-}\rightarrow Cu$) on the substrate 300*a*, resulting in the deposition of the electrically conductive layer (e.g. copper) on the substrate 300*a*. The ion concentration of the plating solution is replenished during the plating cycle by dissolving a metal (e.g. $Cu\rightarrow Cu^{2+}+2e^{-}$) in the actual anode 500.

The actual anode 500 is in the plating bath 400. In some embodiments, the plating solution is continuously provided to the plating bath 400 by a pump (not shown). In some embodiments, the plating solution flows upwards through a plurality of holes (not shown) in the actual anode 500 toward the substrate 300*a*.

In some embodiments, the actual anode 500 includes an anode cup (not shown), ion source material (not shown) and a membrane (not shown). In some embodiments, the anode cup is made of an electrically insulating material, such as polyvinyl chloride (PVC). In some embodiments, the anode cup includes a disk shaped base section having a plurality of spaced openings therein through which plating solution flows. During used, the ion source material electrochemically dissolves, replenishing the ion concentration of the plating solution. In some embodiments, the ion source material is contained in an enclosure formed by the anode cup and the membrane. The membrane covers the ion source material and has a high electrical resistance, which produces a voltage drop across the membrane. This advantageously minimizes variations in the electric field from the ion source material as it dissolves and changes shapes.

The high resistance virtual anode including the first layer 100 and the second layer 200 is between the surface of the substrate 300*a* and the actual anode 500. In some embodiments, the first layer 100 faces the actual anode 500, and the second layer 200 faces the surface of the substrate 300*a*. In some embodiments, the first layer 100 has a planar surface 100*c* and an arc surface 100*d* opposite to each other, and the arc surface 100*d* of the first layer 100 faces the actual anode 500. In some embodiments, the planar surface 100*c* of the first layer 100 faces the second layer 200. In some embodiments, the planar surface 100*c* of the first layer 100 is in contact with the second layer 200. In some embodiments, center of the high resistance virtual anode has a thickness t3 less than a thickness t4 of periphery of the high resistance virtual anode; therefore, electrical resistance of the high resistance virtual anode at the center is less than that thereof at the periphery, and a percentage of the electric current flux passing through the center of the high resistance virtual anode will be higher than a percentage of the electric current flux passing through the periphery of the high resistance virtual anode to avoid the edge effect.

Figure 7:
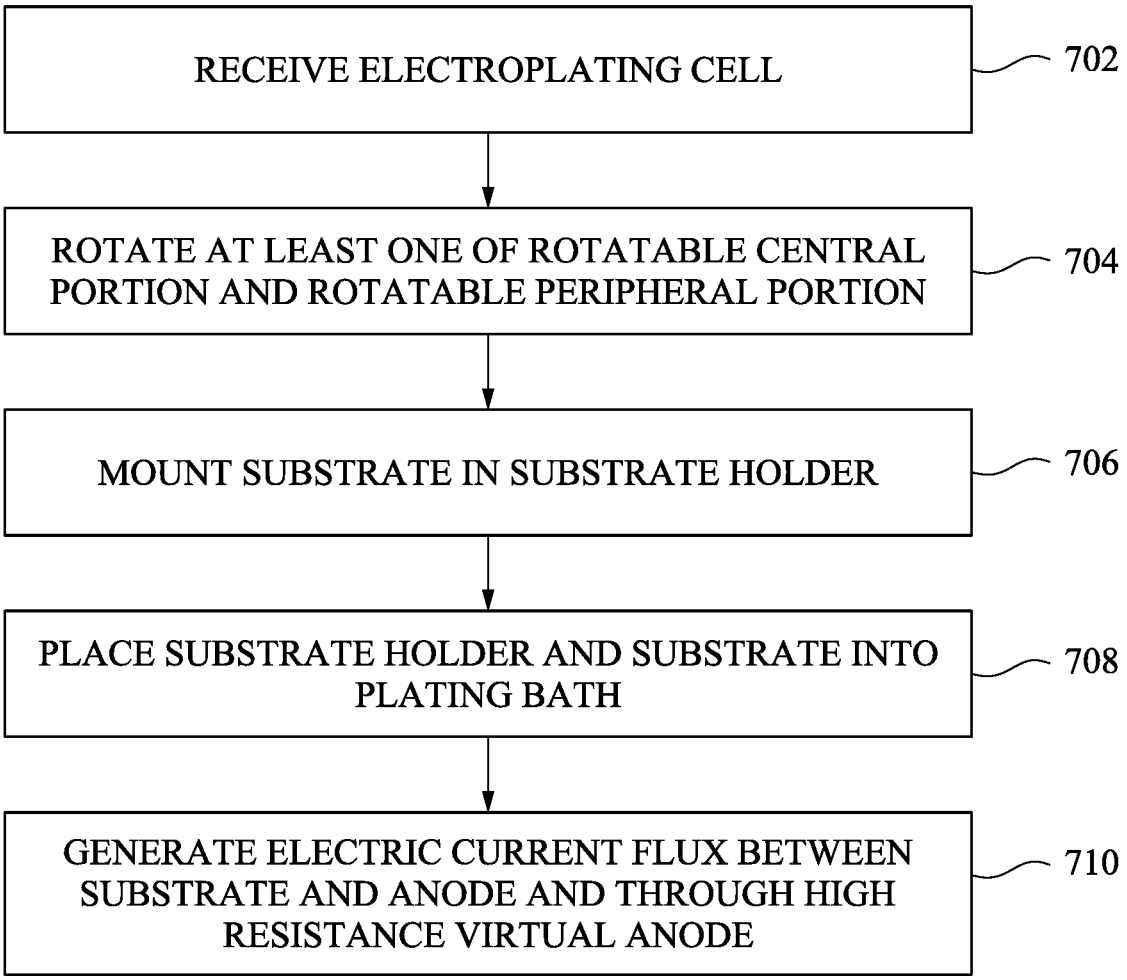
FIG. 7 is an illustrative flowchart of a method of treating a surface of a substrate using an electroplating cell in accordance with some embodiments of the present disclosure.

FIG. 7 is an illustrative flowchart of a method of treating a surface of a substrate in accordance with some embodiments of the present disclosure.

In operation 702, as shown in FIG. 6, an electroplating cell is received, which includes a substrate holder 300 for holding a substrate 300*a* (e.g., semiconductor wafer), a plating bath 400, an anode 500 (i.e., actual anode) in the plating bath 400 and a high resistance virtual anode (e.g., the high resistance virtual anode of FIGS. 3A and 3B including the first layer 100 and the second layer 200) in the plating bath 400.

In some embodiments, as shown in FIGS. 3A and 3B, the first layer 100 includes a plurality of first holes 110 through the first layer 100, in which the first layer 100 includes a rotatable central portion 100*a* and a rotatable peripheral portion 100*b* surrounding the rotatable central portion 100*a*. In some embodiments, as shown in FIGS. 3A and 3B, the second layer 200 is over the first layer 100 and includes a plurality of second holes 210 through the second layer 200.

In operation 704, as shown in FIG. 3A, at least one of the rotatable central portion 100*a* and the rotatable peripheral portion 100*b* of the high resistance virtual anode is rotated to tune through hole size of the high resistance virtual anode. In some embodiments, at least one of the rotatable central portion 100*a* and the rotatable ring-shaped portions 102*b*, 104*b*, 106*b* is rotated to tune the through hole size of the high resistance virtual anode. In some embodiments, rotating the at least one of the rotatable central portion 100*a* and the rotatable peripheral portion 100*b* is conducted by a programmable controller. In some embodiments, rotating the at least one of the rotatable central portion 100*a* and the rotatable peripheral portion 100*b* is conducted using a recipe. In some embodiments, rotating the at least one of the rotatable central portion 100*a* and the rotatable peripheral portion 100*b* is according to size (e.g., diameter) of the substrate 300*a*, the desired thickness profile of the electrically conductive layer to be deposited on the substrate 300*a* and any other suitable parameter.

In operation 706, as shown FIG. 6, the substrate 300*a* is mounted in the substrate holder 300 when the substrate holder 300 is disengaged. Specifically, the substrate 300*a* is mounted in the cup 320. After the substrate 300*a* is loaded, the cone 310 is engaged with the cup 320 to engage the substrate 300*a* against the periphery of the cup 320.

In operation 708, as shown in FIG. 6, the substrate holder 300 and the substrate 300*a* are placed into the plating bath 400 containing plating solution, such that the high resistance virtual anode is between the surface of the substrate 300*a* and the anode 500. In some embodiments, placing the substrate holder 300 and the substrate 300*a* into the plating bath 400 is after rotating the at least one of the rotatable central portion 100*a* and the rotatable peripheral portion 100*b* of the high resistance virtual anode.

In operation 710, as shown in FIG. 6, an electric current flux is generated between the substrate 300*a* and the actual anode 500 and through the high resistance virtual anode to shape the electric current flux and to form an electroplating layer (not shown) over the surface of the substrate 300*a*. In some embodiments, since a thickness t3 of center of the high resistance virtual anode is less than a thickness t4 of periphery of the high resistance virtual anode, electrical resistance of the high resistance virtual anode at the center is less than that thereof at the periphery. Therefore, a percentage of the electric current flux passing through the center of the high resistance virtual anode will be higher than a percentage of the electric current flux passing through the periphery of the high resistance virtual anode to avoid the edge effect, and thus to deposit an uniformly electrically conductive layer over the substrate 300*a*.

In some specific embodiments, for a 450 mm wafer, an electrically conductive layer formed using a commercial high resistance virtual anode has thickness uniformity (equal to standard deviation of thickness/mean of thickness) of 10%. In some specific embodiments, an electrically conductive layer formed using the high resistance virtual anode of the present disclosure has thickness uniformity of 2.5%, which means the high resistance virtual anode of the present disclosure indeed can solve the problem of the edge effect.

According to some embodiments, a high resistance virtual anode for an electroplating cell includes a first layer and a second layer. The first layer includes a plurality of first holes through the first layer. The second layer is over the first layer and includes a plurality of second holes through the second layer.

According to some embodiments, an electroplating cell for treating a surface of a substrate includes a substrate holder, a plating bath, an anode and a high resistance virtual anode. The substrate holder is for holding the substrate. The anode is in the plating bath. The high resistance virtual anode is between the surface of the substrate and the anode. The high resistance virtual anode includes a first layer and a second layer. The first layer includes a plurality of first holes through the first layer. The second layer is over the first layer and includes a plurality of second holes through the second layer.

According to some embodiments, a method includes receiving an electroplating cell, the electroplating cell including: a substrate holder for holding the substrate; a plating bath; an anode in the plating bath; and a high resistance virtual anode in the plating bath, the high resistance virtual anode including: a first layer including a plurality of first holes through the first layer, in which the first layer includes a rotatable central portion and a rotatable peripheral portion surrounding the rotatable central portion; and a second layer over the first layer and including a plurality of second holes through the second layer; rotating at least one of the rotatable central portion and the rotatable peripheral portion; mounting the substrate in the substrate holder; placing the substrate holder and the substrate into the plating bath, such that the high resistance virtual anode is between the surface of the substrate and the anode; and generating an electric current flux between the substrate and the anode and through the high resistance virtual anode to shape the electric current flux and to form an electroplating layer over the surface of the substrate.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method, comprising:

receiving an electroplating cell, the electroplating cell comprising:

a substrate holder for holding a substrate;

a plating bath;

an anode in the plating bath; and a high resistance virtual anode in the plating bath, the high resistance virtual anode comprising:

a first layer comprising a plurality of first holes through the first layer, wherein:

the first layer comprises a rotatable central portion and a rotatable peripheral portion surrounding the rotatable central portion, a first portion of the first holes are through the rotatable central portion of the first layer, and a second portion of the first holes are through the rotatable peripheral portion of the first layer; and a second layer over the first layer and comprising a plurality of second holes through the second layer;

rotating at least one of the rotatable central portion or the rotatable peripheral portion;

mounting the substrate in the substrate holder;

placing the substrate holder and the substrate into the plating bath such that the high resistance virtual anode is between a surface of the substrate and the anode; and generating an electric current flux between the substrate and the anode and through the high resistance virtual anode to shape the electric current flux and to form an electroplating layer over the surface of the substrate.

2. The method of claim 1, wherein a percentage of the electric current flux passing through a center of the high resistance virtual anode is higher than a percentage of the electric current flux passing through a periphery of the high resistance virtual anode.

3. The method of claim 1, wherein rotating the at least one of the rotatable central portion or the rotatable peripheral portion is conducted by a programmable controller.

4. The method of claim 1, wherein at least one of:

rotating the at least one of the rotatable central portion or the rotatable peripheral portion comprises rotating the rotatable central portion independently of the rotatable peripheral portion, or rotating the at least one of the rotatable central portion or the rotatable peripheral portion comprises rotating the rotatable peripheral portion independently of the rotatable central portion.

5. The method of claim 1, comprising rotating the substrate holder and the substrate while generating the electric current flux.

6. The method of claim 1, wherein:

the substrate holder comprises a cup portion and a cone portion, and the method comprises using an air cylinder to provide a vertical force for engaging the cup portion with the cone portion.

7. The method of claim 1, comprising sealing a peripheral edge of the high resistance virtual anode to an edge of the plating bath.

8. The method of claim 1, wherein the rotatable central portion has an opening ratio higher than an opening ratio of the rotatable peripheral portion.

9. The method of claim 1, wherein a hole of the first portion of the first holes has a diameter greater than a diameter of a hole of the second portion of the first holes.

10. The method of claim 1, wherein a hole of the first portion of the first holes has a maximum depth less than a depth of a hole of the second portion of the first holes.

11. The method of claim 1, wherein the rotatable peripheral portion comprises a plurality of rotatable ring-shaped portions coaxially surrounding the rotatable central portion.

12. The method of claim 1, wherein a center of one of the first layer or the second layer has a thickness less than a thickness of a periphery of the one of the first layer or the second layer.

13. The method of claim 1, wherein a thickness of one of the first layer or the second layer is gradually increased from a center to a periphery.

14. A method, comprising:

receiving an electroplating cell, the electroplating cell comprising:

an anode; and a high resistance virtual anode comprising:

a first layer comprising a plurality of first holes through the first layer, wherein the first layer comprises a rotatable central portion and a rotatable peripheral portion surrounding the rotatable central portion; and a second layer over the first layer and comprising a plurality of second holes through the second layer;

rotating at least one of the rotatable central portion or the rotatable peripheral portion; and generating an electric current flux between a substrate and the anode and through the high resistance virtual anode to shape the electric current flux and to form an electroplating layer over a surface of the substrate.

15. The method of claim 14, wherein at least one of:

rotating the at least one of the rotatable central portion or the rotatable peripheral portion comprises rotating the rotatable central portion independently of the rotatable peripheral portion, or rotating the at least one of the rotatable central portion or the rotatable peripheral portion comprises rotating the rotatable peripheral portion independently of the rotatable central portion.

16. The method of claim 14, comprising sealing a peripheral edge of the high resistance virtual anode to a wall of the electroplating cell.

17. The method of claim 14, wherein a percentage of the electric current flux passing through a center of the high resistance virtual anode is higher than a percentage of the electric current flux passing through a periphery of the high resistance virtual anode.

18. A method, comprising:

receiving an electroplating cell, the electroplating cell comprising:

an anode; and a high resistance virtual anode comprising:

a first layer comprising a plurality of first holes through the first layer, wherein the first layer comprises a rotatable central portion and a rotatable peripheral portion surrounding the rotatable central portion, and a second layer over the first layer and comprising a plurality of second holes through the second layer;

sealing a peripheral edge of the high resistance virtual anode to a wall of the electroplating cell; and generating an electric current flux between a substrate and the anode and through the high resistance virtual anode to shape the electric current flux and to form an electroplating layer over a surface of the substrate.

19. The method of claim 18, wherein a center of one of the first layer or the second layer has a thickness less than a thickness of a periphery of the one of the first layer or the second layer.

20. The method of claim 18, wherein a thickness of one of the first layer or the second layer is gradually increased from a center to a periphery.

* * * * *